US007857069B2

(12) United States Patent
Yu

(10) Patent No.: US 7,857,069 B2
(45) Date of Patent: Dec. 28, 2010

(54) SYSTEM VALVE ACTIVATION METHODS FOR DELUGE-LIKE WET PIPE SPRINKLER SYSTEM

(75) Inventor: Hong-Zeng Yu, Foxboro, MA (US)

(73) Assignee: FM Global Technologies LLC, Johnston, RI (US)

( * ) Notice: Subject to any disclaimer, the term of this patent is extended or adjusted under 35 U.S.C. 154(b) by 762 days.

(21) Appl. No.: 11/633,615

(22) Filed: Dec. 5, 2006

(65) Prior Publication Data

US 2008/0128143 A1 Jun. 5, 2008

(51) Int. Cl.

| | |
|---|---|
| ***A62C 2/00*** | (2006.01) |
| ***A62C 35/00*** | (2006.01) |
| ***A62C 37/36*** | (2006.01) |
| ***A62C 37/08*** | (2006.01) |
| ***A62C 3/06*** | (2006.01) |
| ***A62C 37/10*** | (2006.01) |
| ***B05B 3/00*** | (2006.01) |
| ***B05B 15/06*** | (2006.01) |

(52) U.S. Cl. ..... 169/46; 169/5; 169/8; 169/14; 169/16; 169/17; 169/18; 169/19; 169/20; 169/37; 169/43; 169/44; 169/47; 169/56; 169/61; 239/208; 239/209

(58) Field of Classification Search ..... 169/16, 169/19, 20, 8, 17, 37, 43, 46, 47, 56, 14, 169/5, 61, 18, 44; 239/208, 209
See application file for complete search history.

(56) References Cited

U.S. PATENT DOCUMENTS

| | | | | |
|---|---|---|---|---|
| 2,290,358 A | * | 7/1942 | Rider | 169/17 |
| 2,713,916 A | * | 7/1955 | Muckenfuss | 169/19 |
| 2,724,444 A | * | 11/1955 | Rider | 169/9 |
| 4,023,164 A | | 5/1977 | Delaney | |
| 4,033,740 A | | 7/1977 | Meckler | |
| 4,611,290 A | | 9/1986 | Henningsen et al. | |
| 5,236,049 A | | 8/1993 | Asselin et al. | |
| 5,720,351 A | * | 2/1998 | Beukema et al. | 169/61 |

(Continued)

FOREIGN PATENT DOCUMENTS

| | | | |
|---|---|---|---|
| JP | 07-012382 | * | 2/1995 |

OTHER PUBLICATIONS

English language translation of JP 07012382.

*Primary Examiner*—Len Tran
*Assistant Examiner*—Steven M Cernoch
(74) *Attorney, Agent, or Firm*—Merek, Blackmon & Voorhees, LLC

(57) ABSTRACT

A method for activating a sprinkler system comprises maintaining a liquid extinguishant in system pipes under a standby pressure that is less than the operating pressure, determining an arrangement of the sprinklers that will control a fire, and opening the sprinkler system valve in response to a drop in pressure in each of the pipes to which at least one of the sprinklers of the arrangement is connected. An alternate method comprises providing a bypass around the system valve, and opening the system valve in response to (1) a predetermined flow of liquid extinguishant through the bypass and (2) a drop in pressure in the sprinkler system below a predetermined pressure. In a variation of the alternate method, the system valve is opened in response only to a predetermined flow of liquid extinguishant through the bypass.

24 Claims, 2 Drawing Sheets

U.S. PATENT DOCUMENTS 5,992,532 A * 11/1999 Ramsey et al. ..... 169/46
6,209,654 B1 * 4/2001 Curless ..... 169/17
6,333,689 B1 * 12/2001 Young ..... 340/506
6,367,560 B1 * 4/2002 de Ris et al. ..... 169/43
6,415,870 B1 * 7/2002 Matsuoka ..... 169/16
6,422,319 B2 * 7/2002 Haase, III ..... 169/16
6,840,457 B2 * 1/2005 Park et al. ..... 239/69
6,848,513 B2 2/2005 Jackson et al.
7,055,612 B2 * 6/2006 Jackson et al. ..... 169/17
7,383,892 B2 * 6/2008 Jackson ..... 169/16
7,389,824 B2 * 6/2008 Jackson ..... 169/16
2003/0066903 A1 * 4/2003 Park et al. ..... 239/68
2005/0072580 A1 * 4/2005 Jackson ..... 169/16
2006/0021759 A1 * 2/2006 Golinveaux ..... 169/17
2006/0021760 A1 * 2/2006 Golinveaux ..... 169/17
2006/0021761 A1 * 2/2006 Golinveaux ..... 169/17
2006/0021762 A1 * 2/2006 Golinveaux ..... 169/17
2006/0090908 A1 5/2006 Jackson et al.
2006/0243459 A1 * 11/2006 Jackson ..... 169/16
2006/0278410 A1 * 12/2006 Reilly et al. ..... 169/37
2006/0289174 A1 * 12/2006 Yu ..... 169/16

* cited by examiner

FIG. 1
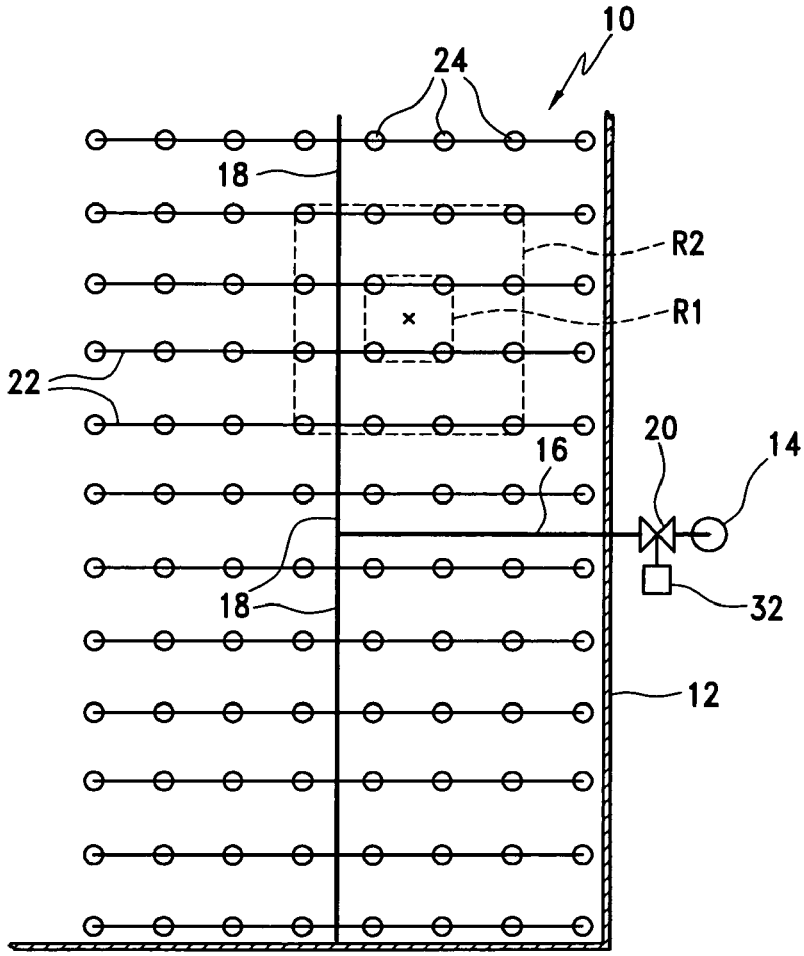
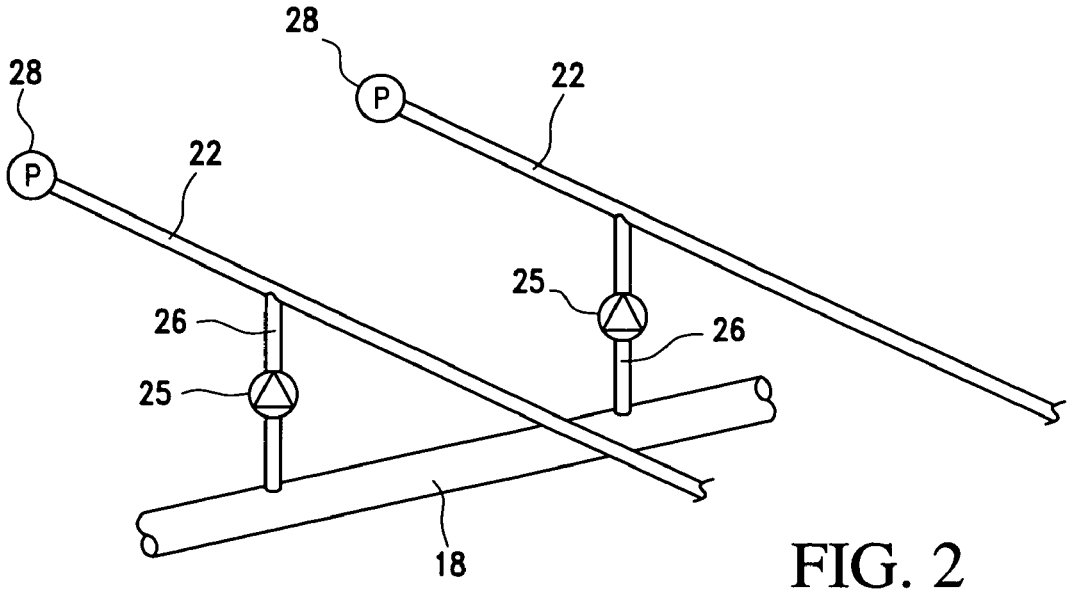
FIG. 2

SYSTEM VALVE ACTIVATION METHODS FOR DELUGE-LIKE WET PIPE SPRINKLER SYSTEM

BACKGROUND OF THE INVENTION

A typical sprinkler system for fire protection is connected to a water supply (city supply, gravity tank or pump) and includes a system riser pipe that feeds a main pipe, a system valve that is typically located in the riser pipe, cross main pipes that receive water from the main pipe and feed branch lines, branch lines, sprinklers mounted in the branch lines, and other accessories. In a conventional wet-pipe sprinkler system, water is discharged under pressure as soon as the first sprinkler directly above a fire is actuated, or as soon as the first few sprinklers directly above a fire are actuated. Additional sprinklers will not be actuated until the fire grows further and overpowers the sprinkler or sprinklers that are already operating.

Control-mode wet-pipe fire sprinkler protection systems use ceiling sprinklers that are equipped with thermal sensing elements, typically fusible links or glass bulbs, and, prior to the fire protection sprinkler systems disclosed in co-pending U.S. application Ser. No. 11/370,904 of Hong-Zeng Yu, filed on Mar. 9, 2006, had high temperature ratings and low thermal sensitivity. The low thermal sensitivity means that the thermal sensing elements had high Response-Time-Index (RTI) values. Response-Time-Index indicates how fast a sprinkler can absorb, from its surroundings, heat sufficient to cause actuation.

As a result of the high Response-Time-Index values, the control-mode wet-pipe systems in general actuated relatively slowly and had to fight against fires that were already large when water began to discharge from actuated sprinklers. As the fire challenge increased, more and more water droplets tended to be deflected by the fire plume back up to the ceiling level and carried laterally in the ceiling gas flow. Water droplets present in the ceiling gas flow can impact, wet and cool the thermal sensing elements of sprinklers adjacent to the operating sprinklers and, thus, cause temporary or permanent delay of the actuation of these adjacent sprinklers, which are close to the fire, while sprinklers that are farther from the fire and have unwetted thermal sensing elements are actuated.

The aforementioned temporary or permanent delay of sprinkler actuations is known as sprinkler skipping. For wet-pipe sprinkler systems known before those of Ser. No. 11/370,904, sprinkler skipping could be caused by one or more sprinklers discharging water as soon as they are actuated by the fire. As a result, the water spray coverage area varied with time and could consist of dry spots or low water-flux spots in the protected area. Consequently, the fire continued to spread, and the effectiveness of the sprinkler protection was severely reduced.

In fire protection sprinkler systems disclosed in Ser. No. 11/370,904, which is incorporated herein by reference in its entirety, water is not discharged from any sprinklers until all of the sprinklers in a designated area above the fire are actuated. By "actuated" is meant that a sprinkler is opened, not necessarily that water or another extinguishant flows under operating pressure through the sprinkler. By "designated area" is meant the area directly above a fire, so that water discharged from the actuated sprinklers in the designated area covers the fire. In sprinkler systems disclosed in Ser. No. 11/370,904, the sprinklers in the designated area actuate progressively in all radial directions from the fire origin without skipping, because no water is discharged until all the sprinklers in the designated area above the fire are actuated. Then, water is discharged simultaneously from all the actuated sprinklers. As a result, the fire is completely covered and surrounded by the sprinkler sprays, with no dry spots, and the effectiveness of the sprinkler system does not suffer due to sprinkler skipping. Sprinkler skipping is pre-empted by deluging the fire with closed-head type sprinklers, including conventional sprinklers and spray sprinklers.

The sprinkler systems disclosed in Ser. No. 11/370,904 are in contrast to sprinkler systems commonly called "deluge" sprinkler systems. In "deluge" sprinkler systems, the sprinklers have no thermal sensing elements, such as fusible links or glass bulbs, but instead are always open to allow water to flow out freely from all of the sprinklers. A system valve that is opened by a fire detector is provided in "deluge" sprinkler systems upstream of all of the sprinklers. The sprinkler systems disclosed in Ser. No. 11/370,904 enable sprinklers having thermal sensing elements to produce a deluge of water through all of the sprinklers in the designated area all at once, thereby suppressing the fire, even though the thermal sensing elements keep the sprinklers closed until actuation. As a result, no or few additional sprinklers are needed to be actuated beyond the designated area.

In order to cover the fire hazards in most industrial occupancies, the sprinkler systems disclosed in Ser. No. 11/370,904 overcome the problem of sprinkler skipping by assuring that all of the sprinklers in the designated area actuate more quickly than in known systems and at the same time as one another. The sprinklers have an RTI value and a temperature rating such that the combination of the RTI value and the temperature rating prevents the sprinklers that are outside a designated area directly above the fire from actuating before extinguishant that is under the pressure of a source is discharged from any of the sprinklers of the sprinkler system. Extinguishant does not flow out of any of the sprinklers instantaneously. Instead, the RTI and the temperature rating are chosen such that the thermal elements of a group of sprinklers in the designated area actuate before extinguishant under the operating pressure is discharged from any of the sprinklers. Nevertheless, the extinguishant in the system begins discharging under pressure from the actuated sprinklers fast, that is, faster than in conventional dry-pipe systems. Since the pattern of ceiling gas flow induced by a fire plume is close to being axi-symmetrical, and since the arrangement of sprinklers in a sprinkler system is typically in square or rectangular pattern, the area in which sprinklers actuate tends to have a pattern of between circular and square or between circular and rectangular. The system valve, which is positioned upstream of all of the sprinklers in the system, is timed to open after or shortly before all of the sprinklers exposed to the fire have actuated, so that sprinklers discharge at the designated operating pressure shortly after all the sprinklers in the designated area are actuated.

One of the essential elements for the deluge-like wet-pipe sprinkler system is a system valve which is capable of activating timely so that the actuated sprinklers will discharge at the operating pressure at or shortly after the time when all the sprinklers in the intended spray coverage area are actuated.

Since the sprinkler pipes are filled with water, or other liquid extinguishant, for wet-pipe applications, the time delay for extinguishant pressure to reach the designated operating pressure is estimated to be less than five seconds after the system valve is activated where the extinguishant comes from a typical water supply required for warehouse protection. Because of the small time delay, the system valve should activate around the time when all or most of the sprinklers in the designated area are actuated, depending on the actual time delay.

U.S. Pat. No. 5,511,621 to Yao discloses a dry-pipe sprinkler system in which the discharge of water from nozzles over a fire is delayed until one or two rings of nozzles around the fire actuate.

SUMMARY OF THE INVENTION

By the present invention, system valve activation methods are provided for deluge-like wet-pipe sprinkler systems, particularly those disclosed in Ser. No. 11/370,904.

In a first method according to the present invention, a liquid extinguishant, for example, water, is maintained in the pipes under a standby pressure that is less than the operating pressure, whereby opening of at least one sprinkler connected to one of the pipes causes a drop in pressure in that pipe. The opening of at least one sprinkler connected to one of the pipes causes a drop in pressure in that pipe. An arrangement of the sprinklers that will control a fire is determined, and a system valve is opened in response to a drop in pressure in each of the pipes to which at least one of the sprinklers of the arrangement is connected.

In a second method according to the present invention, a liquid extinguishant is maintained in the sprinkler system downstream of a system valve under a standby pressure that is less than the operating pressure. A first number of sprinklers in an arrangement of the sprinklers that can control a fire is determined. A bypass is provided around the system valve to provide fluid communication between a source of liquid extinguishant under operating pressure and the pipes and sprinklers of the sprinkler system. The pressure of the liquid extinguishant in the bypass is reduced to the standby pressure. The total flow rate of liquid extinguishant that can flow, at the standby pressure, through a predetermined second number of the sprinklers, when actuated, that is fewer than the first number of sprinklers is calculated. The flow of liquid extinguishant through the bypass at the standby pressure is limited to a flow that is equal to the calculated total flow rate of liquid extinguishant through the second number of the sprinklers, whereby the pressure of liquid extinguishant in the sprinkler system downstream of the bypass falls below the standby pressure when a number of the sprinklers actuate that exceeds the second number of the sprinklers. The system valve is opened in response to: (1) a flow of liquid extinguishant through the bypass that is equal to or greater than the calculated total flow rate of liquid extinguishant through the second number of the sprinklers and (2) a drop in pressure in the sprinkler system below a predetermined pressure that is below the standby pressure.

In a variation of the second method, the total flow rate of liquid extinguishant that can flow, at the standby pressure, through the number of the sprinklers in an arrangement of the sprinklers that can control a fire is calculated; and the system valve is opened in response to a flow of liquid extinguishant through the bypass that is equal to or exceeds the calculated total flow rate of liquid extinguishant through that number of the sprinklers.

The methods according to the present invention can be used to integrate the system valve activation process seamlessly into the operation of a deluge-like sprinkler protection system, for example, the deluge-like sprinkler protection system disclosed in Ser. No. 11/370,904. Although the methods according to the present invention are generally described herein in connection with control-mode sprinkler systems, they can also be used with suppression-mode sprinkler systems.

BRIEF DESCRIPTION OF THE DRAWINGS

FIG. 1 is a schematic top plan view of a sprinkler system employing a first method according to the present invention;

FIG. 2 is a schematic perspective view of a portion of the sprinkler system of FIG. 1 pertaining to the first method;

DETAILED DESCRIPTION OF THE PREFERRED EMBODIMENTS

Figure 3:
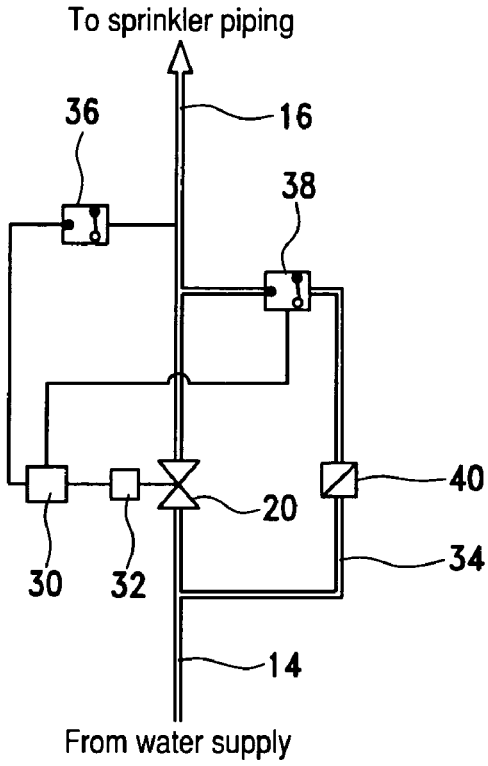
FIG. 3 is a schematic illustration of a portion of a sprinkler system employing a second method according to the present invention.

As can be seen from FIG. 1, a sprinkler system according to the present invention, which is designated generally by the reference numeral 10, is shown installed in a building 12 for controlling a fire. The building 12 is typically a building, such as a warehouse, having a ceiling beneath which a hot ceiling gas flows generally horizontally in the event of a fire. The sprinkler system 10 receives water under an operating pressure from a water supply (city supply, gravity tank or pump) and includes a system riser pipe 14 feeding a main pipe 16 that in turn feeds cross main pipes 18, a system valve 20 that is typically located in the riser pipe, branch pipes 22 extending from spaced locations along a cross main pipe, and sprinklers 24 mounted in the branch pipes, as well as accessories. By "pipe" is meant any structure for conducting an extinguishant, including rigid conduits and flexible conduits.

Usually, the sprinklers 24 connected to each of the branch pipes 22 are spaced from one another by a first distance and are spaced from adjacent sprinklers 24 connected to adjacent branch pipes by a second distance that is generally equal to the first distance. The sprinklers 24 together cover an area extending across at least the area of any fire that might occur. Only a portion of the building 12 is indicated in FIG. 1, it being understood that other sprinkler systems 10 according to the present invention can provide coverage for other portions of the building.

In accordance with a first method according to the present invention for activating a sprinkler system, a liquid extinguishant, for example, water, in the pipes 16, 18 and 22 downstream of the system valve 20 is maintained under a standby pressure that is less than the operating pressure. This can be done by filling the sprinkler system 10 through a flow path that does not include the system valve 20. A suitable standby pressure is, for example, 2 psig. Actuation, or opening, of at least one sprinkler 24 connected to one of the branch pipes 22 causes a drop in pressure in that pipe.

As can be appreciated from FIG. 2, each branch line 22 is isolated from the rest of the sprinkler piping system by a pressure-activated check valve 25 that can be located in a short pipe 26 that extends between the cross main pipe 18 and the branch pipe 22. The pressure-activated check valve 25 has a tripping pressure equal to the standby pressure. As a result, when a sprinkler 24 opens in the branch pipe 22 with which the pressure-activated check valve 25 is associated, the pressure in that branch pipe goes below the standby pressure, thereby activating the check valve in order to prevent flow into the branch pipe from the cross main pipe 18. For clarity of illustration, the sprinklers 24 are not shown in the branch pipes 22 in FIG. 2. A pressure transducer 28 is also in fluid communication with each of the branch pipes 22. When one or more sprinklers 24 of a branch pipe 22 are actuated, the resulting pressure drop to a predetermined pressure lower than the standby pressure is detected by the pressure transducer 28, which sends a signal to a control panel 30, such as a central control panel, that operates a system valve controller 32 to open the system valve 20.

Also in accordance with the first method according to the present invention, an arrangement of the sprinklers 24 that is less than all of the sprinklers of the sprinkler system and can control a fire is determined. The arrangement of the sprinklers 24 that can control a fire is usually an arrangement that surrounds the fire. In the embodiment of FIG. 1, for example, it was determined that two concentric rings R1 and R2 of the sprinklers 24 will control a fire centered at the point 'x'. The sprinklers 24 that provide the two rings of spray coverage for fire-control protection are situated on four consecutive branch pipes 22.

When at least one of the sprinklers 24 in a branch pipe 22 actuates, or opens, a signal is transmitted by a pressure transducer 28 to the control panel 30 and is registered in the control panel in response to a drop in pressure in the branch pipe 22 with which the pressure transducer is associated. The control panel 30 is programmed to operate the system valve controller 32 to open the system valve 20 when the control panel receives signals from the pressure transducers 28 of a predetermined number of consecutive branch pipes 22. In the embodiment of FIG. 1, the system valve controller 32 opens the system valve 20 when the control panel 30 receives signals from the pressure transducers 28 of four consecutive branch pipes 22 detecting pressure drops caused by at least one sprinkler actuation in each of the pipes. Although an example is described in which the system valve 20 is opened when at least one sprinkler 24 in each of four consecutive branch pipes 22 actuates, the first method according to the present invention contemplates as alternatives opening the system valve when at least one sprinkler actuates in each of a number of consecutive branch pipes that is different from four.

A second method of the present invention can be understood best when FIG. 3 is considered in connection with FIG. 1. A liquid extinguishant in the pipes of the sprinkler system 10 is maintained under a standby pressure, for example, 5 psig or less, that is less than the operating pressure. As with the first-described method, an arrangement of the sprinklers 24 that can control a fire is determined. Furthermore, in accordance with the second method, a bypass 34 is provided around the system valve 20 to provide fluid communication between the source of liquid extinguishant and the pipes and sprinklers of the sprinkler system 10. The check valves 25 and the pressure transducers 28 associated with each branch pipe 22 in the first method described herein are not needed for the second method. Instead, a low-pressure switch 36 is positioned in the sprinkler system 10 downstream of the system valve 20, for example, in the riser 14 or the main pipe 16. In addition, a flow switch 38 and a pressure regulator 40 are positioned in the bypass 34. The flow switch 38 and the low-pressure switch 36 are each arranged to send a signal to the control panel 30 when a certain event is detected.

Based on the K-factor of the sprinklers 24, the expected discharge rate per sprinkler 24 at the standby pressure can be calculated. The set point of the flow switch 38 is set to equal the total flow rate, at the standby pressure, through a predetermined number of sprinklers 24, when open. In accordance with the second method of the present invention, the predetermined number of sprinklers 24 is fewer than the number of sprinklers in the previously determined arrangement of the sprinklers 24 that can control a fire. Thus, where the system valve 20 is to be opened when a total of 16 of the sprinklers 24 is actuated, the set point of the flow switch 38 is set to equal the total flow rate of fewer than 16 sprinklers, for example, 12 sprinklers. When the flow through the bypass 34 equals or exceeds the set point of the flow switch 38, which, in the example, is the total flow through 12 sprinklers at the standby pressure, the flow switch sends a signal to the control panel 30.

Also in accordance with the second method mentioned above, the pressure regulator 40 is sized to limit the flow of liquid extinguishant through the bypass 34 at the standby pressure to the calculated total flow, at the standby pressure, through the predetermined number of the sprinklers 24 that is fewer than the number of sprinklers in the arrangement of the sprinklers 24 that can control a fire. The actuation, or opening, of sprinklers 24 in the sprinkler system 10 will not cause a drop in pressure in the system due to the pressure regulator 40 in the bypass 34, as long as the flow rate in the bypass does not exceed the constant-pressure capacity of the pressure regulator. The flow capacity of the pressure regulator 40 is adjusted such that the downstream pressure of the regulator begins to decrease from the standby pressure when the number of sprinkler operations exceeds the predetermined number. As a result, the standby pressure in the sprinkler system 10 cannot be sustained when the number of sprinkler actuations or openings exceeds the predetermined number, and the pressure of liquid extinguishant in the sprinkler system downstream of the bypass 34 falls below a predetermined pressure that is lower than the standby pressure. Consequently, the low-pressure switch 36 sends a signal to the control panel 30.

The predetermined number of the sprinklers that is fewer than the number of sprinklers in the arrangement of the sprinklers 24 that can control a fire can be different from case to case, depending on how quickly the low pressure set point of the low-pressure switch can be reached based on the functional relationship between flow rate and downstream pressure for a particular pressure regulator 40.

In accordance with the second method, the system valve 20 is opened in response to: (1) a flow of liquid extinguishant through the bypass 34 that is equal to or greater than the calculated total flow rate of liquid extinguishant through the predetermined number of the sprinklers 24, and (2) a drop in pressure in the sprinkler system 10 below a pre-determined pressure that is lower than the standby pressure. Thus, the system valve 20 is opened when the control panel 30 receives a signal from the low-pressure switch 36 and a signal from the flow switch 38.

Figure 4:
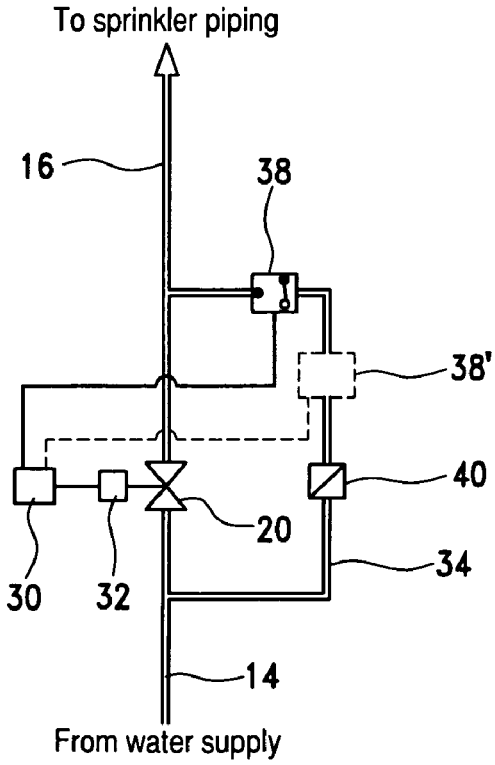
FIG. 4 is a schematic illustration of a portion of a sprinkler system employing a variation of the second method.

In a variation of the second method, which can be understood best when FIG. 4 is considered in connection with FIG. 1, the system valve 20 is opened in response to a flow of liquid extinguishant through the bypass 34 that is equal to or greater than the calculated total flow rate of liquid extinguishant through the number of sprinklers 24 in the arrangement that can control a fire. The system valve 20 is opened when the control panel 30 receives a signal from the flow switch 38 and, in turn, signals the controller 32 to open the system valve. The system valve 20 is opened without regard to a pressure drop in the sprinkler system 10. If desired, a second flow switch 38' can be provided to detect the flow of liquid extinguishant through the bypass 34, and, in that case, the system valve is opened in response to a detection, by either of the flow switches 38 or 38', of a flow of liquid extinguishant through the bypass that is equal to or greater than the calculated total flow rate of liquid extinguishant through the number of sprinklers 24 in the arrangement that can control a fire.

It can be appreciated from FIG. 1 that the number of sprinklers 24 in the two rings R1 and R2 that can control a fire in the illustrated example can be 16. However, it might be found to be advantageous to set the system valve 20 to open even if the sprinklers 24 at the corners of the outer ring R2 have not yet actuated. In that case, the sprinkler system 10 can be set such that the system valve 20 opens when only 12 of the sprinklers 24 have actuated. Also in that case, the set point of the flow switch 38 is set to equal the total flow rate, at the standby pressure, through a predetermined number of sprinklers 24, when open, that is fewer than 12.

The methods according to the present invention are not limited to any specific number of sprinklers in the arrangement that might be determined to be capable of controlling a fire. The number of sprinklers can be a number between 12 and 16, or a number less than 12, for example, in a case in which it has been determined that the extinguishant should begin flowing under operating pressure through the sprinklers 24 when only the inner ring R1 of sprinklers 24 have all actuated. On the other hand, the number of sprinklers 24 in the arrangement can be greater than 16, for example, in a case in which it has been determined that the extinguishant should begin flowing under operating pressure through the sprinklers 24 when three rings of sprinklers 24 have all actuated. Furthermore, the 12 sprinklers of the ring R2 excluding the sprinklers at the corners of the ring can be considered to constitute a ring in itself having a shape different from the shape of the ring R2. Moreover, the number of actuated or opened sprinklers 24 for which the system valve 20 is set to open can be chosen to take into account a) that one or more sprinklers 24 that are not in the contemplated arrangement might actuate before one or more sprinklers 24 of the contemplated arrangement actuates, and/or b) that one or more sprinklers 24 of the contemplated arrangement might not actuate when the other sprinklers 24 in the contemplated arrangement actuate.

It will be apparent to those skilled in the art and it is contemplated that variations and/or changes in the embodiments illustrated and described herein may be made without departure from the present invention. Accordingly, it is intended that the foregoing description is illustrative only, not limiting, and that the true spirit and scope of the present invention will be determined by the appended claims.

The invention claimed is:

1. A method for activating a sprinkler system having sprinklers, pipes and a system valve that controls the flow of a liquid extinguishant under an operating pressure from a source to the pipes and sprinklers, the sprinklers being connected to the pipes, comprising:

maintaining a liquid extinguishant in the pipes under a standby pressure that is less than the operating pressure, whereby opening of at least one sprinkler connected to one of the pipes causes a drop in pressure in said one of the pipes;

determining an arrangement of the sprinklers that is less than all of the sprinklers of the sprinkler system and will control a fire, wherein the arrangement includes sprinklers connected to a plurality of the pipes; and opening the system valve in response to a drop in pressure in each of the plurality of the pipes to which at least one of the sprinklers of the arrangement is connected.

2. The method of claim 1, wherein the arrangement of sprinklers surrounds the fire.

3. The method of claim 1, wherein the arrangement of sprinklers comprises at least one ring of sprinklers.

4. The method of claim 1, wherein the arrangement comprises two generally concentric rings of sprinklers.

5. The method of claim 1, wherein the pipes to which the sprinklers are connected are branch pipes extending from spaced locations along a main pipe, and the arrangement of sprinklers comprises sprinklers connected to a predetermined number of the branch pipes that have consecutive spaced locations along the main pipe.

6. The method of claim 5, wherein the sprinklers connected to each of the branch pipes are spaced from one another by a first distance and are spaced from adjacent sprinklers connected to adjacent branch pipes by a second distance, wherein the second distance is generally equal to the first distance.

7. The method of claim 6, wherein the arrangement comprises approximately 16 sprinklers connected to approximately 4 consecutive branch pipes.

8. The method of claim 1, further comprising isolating from the rest of the sprinkler system each pipe to which at least one sprinkler that has opened is connected, such that the at least one open sprinkler does not cause a pressure drop in the sprinkler system outside the pipe to which the at least one sprinkler is connected.

9. The method of claim 1, wherein a signal is transmitted to a control panel in response to a drop in pressure in each of the pipes to which at least one of the sprinklers of the arrangement is connected, and the control panel operates a system valve controller to open the system valve in response to a drop in pressure in each of the pipes to which at least one of the sprinklers of the arrangement is connected.

10. A method for activating a sprinkler system having sprinklers, pipes and a system valve that controls the flow of a liquid extinguishant under an operating pressure from a source to the pipes and sprinklers, the sprinklers being connected to the pipes, comprising:

maintaining a liquid extinguishant in the sprinkler system downstream of the system valve under a standby pressure that is less than the operating pressure;

determining a first number of sprinklers in an arrangement of the sprinklers that can control a fire;

providing a bypass around the system valve to provide fluid communication between the source of liquid extinguishant under operating pressure and the pipes and sprinklers;

reducing the pressure of the liquid extinguishant in the bypass to the standby pressure;

calculating the total flow rate of liquid extinguishant that can flow, at the standby pressure, through a second number of the sprinklers, when actuated, that is fewer than the first number of sprinklers;

limiting the flow of liquid extinguishant through the bypass at the standby pressure to a flow that is equal to the calculated total flow rate of liquid extinguishant through the second number of the sprinklers, whereby the pressure of liquid extinguishant in the sprinkler system downstream of the bypass falls below the standby pressure when a number of the sprinklers actuate that exceeds the second number of the sprinklers; and opening the system valve in response to (1) a flow of liquid extinguishant through the bypass that is at least equal to the calculated total flow rate of liquid extinguishant through said second number of the sprinklers and (2) a drop in pressure in the sprinkler system below the standby pressure.

11. The method of claim 10, wherein the arrangement of sprinklers surrounds the fire.

12. The method of claim 10, wherein the arrangement of sprinklers comprises at least one ring of sprinklers.

13. The method of claim 10, wherein the arrangement comprises two generally concentric rings of sprinklers.

14. The method of claim 10, wherein the pipes to which the sprinklers are connected are branch pipes extending from spaced locations along a main pipe, and the arrangement of sprinklers comprises sprinklers connected to a predetermined number of the branch pipes that have consecutive spaced locations along the main pipe.

15. The method of claim 14, wherein the sprinklers connected to each of the branch pipes are spaced from one another by a first distance and are spaced from adjacent sprinklers connected to adjacent branch pipes by a second distance, wherein the second distance is generally equal to the first distance.

16. The method of claim 15, wherein the arrangement comprises approximately 16 sprinklers connected to approximately 4 consecutive branch pipes.

17. A method for activating a sprinkler system having sprinklers, pipes and a system valve that controls the flow of a liquid extinguishant under an operating pressure from a source to the pipes and sprinklers, the sprinklers being connected to the pipes, comprising:

maintaining a liquid extinguishant in the sprinkler system downstream of the system valve under a standby pressure that is less than the operating pressure;

determining the number of sprinklers in an arrangement of the sprinklers that can control a fire;

providing a bypass around the system valve to provide fluid communication between the source of liquid extinguishant under operating pressure and the pipes and sprinklers;

reducing the pressure of the liquid extinguishant in the bypass to the standby pressure;

calculating the total flow rate of liquid extinguishant that can flow, at the standby pressure, through said number of the sprinklers, when actuated; and opening the system valve in response to a flow of liquid extinguishant through the bypass that is at least equal to the calculated total flow rate of liquid extinguishant through said number of the sprinklers.

18. The method of claim 17, wherein the arrangement of sprinklers surrounds the fire.

19. The method of claim 17, wherein the arrangement of sprinklers comprises at least one ring of sprinklers.

20. The method of claim 17, wherein the arrangement comprises two generally concentric rings of sprinklers.

21. The method of claim 17, wherein the pipes to which the sprinklers are connected are branch pipes extending from spaced locations along a main pipe, and the arrangement of sprinklers comprises sprinklers connected to a predetermined number of the branch pipes that have consecutive spaced locations along the main pipe.

22. The method of claim 21, wherein the sprinklers connected to each of the branch pipes are spaced from one another by a first distance and are spaced from adjacent sprinklers connected to adjacent branch pipes by a second distance, wherein the second distance is generally equal to the first distance.

23. The method of claim 22, wherein the arrangement comprises approximately 16 sprinklers connected to approximately 4 consecutive branch pipes.

24. The method of claim 17, wherein two devices are provided to detect a flow of liquid extinguishant through the bypass that is at least equal to the calculated total flow rate of liquid extinguishant through said number of sprinklers, and the system valve is opened in response to a detection, by either of the devices, of a flow of liquid extinguishant through the bypass that is at least equal to the calculated total flow rate of liquid extinguishant through said number of sprinklers.

* * * * *